US007197841B2

(12) United States Patent
Hsu

(10) Patent No.: US 7,197,841 B2
(45) Date of Patent: Apr. 3, 2007

(54) INFLATABLE DOLL DISPLAY

(75) Inventor: Sheng-Hung Hsu, Renwu Hsiang (TW)

(73) Assignee: Gemmy Industries Corporation, Coppell, TX (US)

( * ) Notice: Subject to any disclaimer, the term of this patent is extended or adjusted under 35 U.S.C. 154(b) by 138 days.

(21) Appl. No.: 11/183,057

(22) Filed: Jul. 15, 2005

(65) Prior Publication Data

US 2007/0011923 A1 Jan. 18, 2007

(51) Int. Cl.
*G09F 19/08* (2006.01)
*G09F 19/02* (2006.01)
*G09F 15/00* (2006.01)

(52) U.S. Cl. ..... 40/412; 40/610; 40/212

(58) Field of Classification Search ..... 40/412
See application file for complete search history.

(56) References Cited

U.S. PATENT DOCUMENTS 4,920,674 A * 5/1990 Shaeffer ..... 40/412
6,804,905 B1 * 10/2004 Burger et al. ..... 40/610

* cited by examiner

*Primary Examiner*—Lesley D. Morris
*Assistant Examiner*—Shin Kim

(57) ABSTRACT

An inflatable doll display has a barrel and a doll. The barrel has an inner wall and an outer wall, and a board transversely provided in an interior of the barrel to form an upper chamber and a lower chamber. The fabric doll is provided on the board and has a plane transversely provided in a middle portion of the doll to form an upper part and a lower part. An inflator is mounted in the lower chamber and has a first tube which is received between the inner wall and the outer wall, and a second tube which is inserted into the lower part. A first end of a third tube is inserted into the barrel and a second end of the third tube is inserted into the upper part. Hence, with the alternating operation of the inflator, the doll is raised or lowered to achieve an attractive effect.

3 Claims, 4 Drawing Sheets

INFLATABLE DOLL DISPLAY

BACKGROUND OF THE INVENTION

1. Field of the Invention

The present invention relates to an inflatable doll display, and more particularly to an inflatable doll which can be raised or lowered.

2. Description of Related Art

At present, exhibitions, etc have all kinds of inflatable dolls, effigies, etc to display in order to attract people. The inflatable doll is made of fabric and the air is pumped into the doll thereby expanding the doll. However, the inflated doll stands statically instead of moving such that it lacks attractiveness.

Therefore, the invention provides an inflatable doll display to mitigate or obviate the aforementioned problems.

SUMMARY OF THE INVENTION

The main objective of the present invention is to provide an inflatable doll display in which the doll can be raised or lowered in turn.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
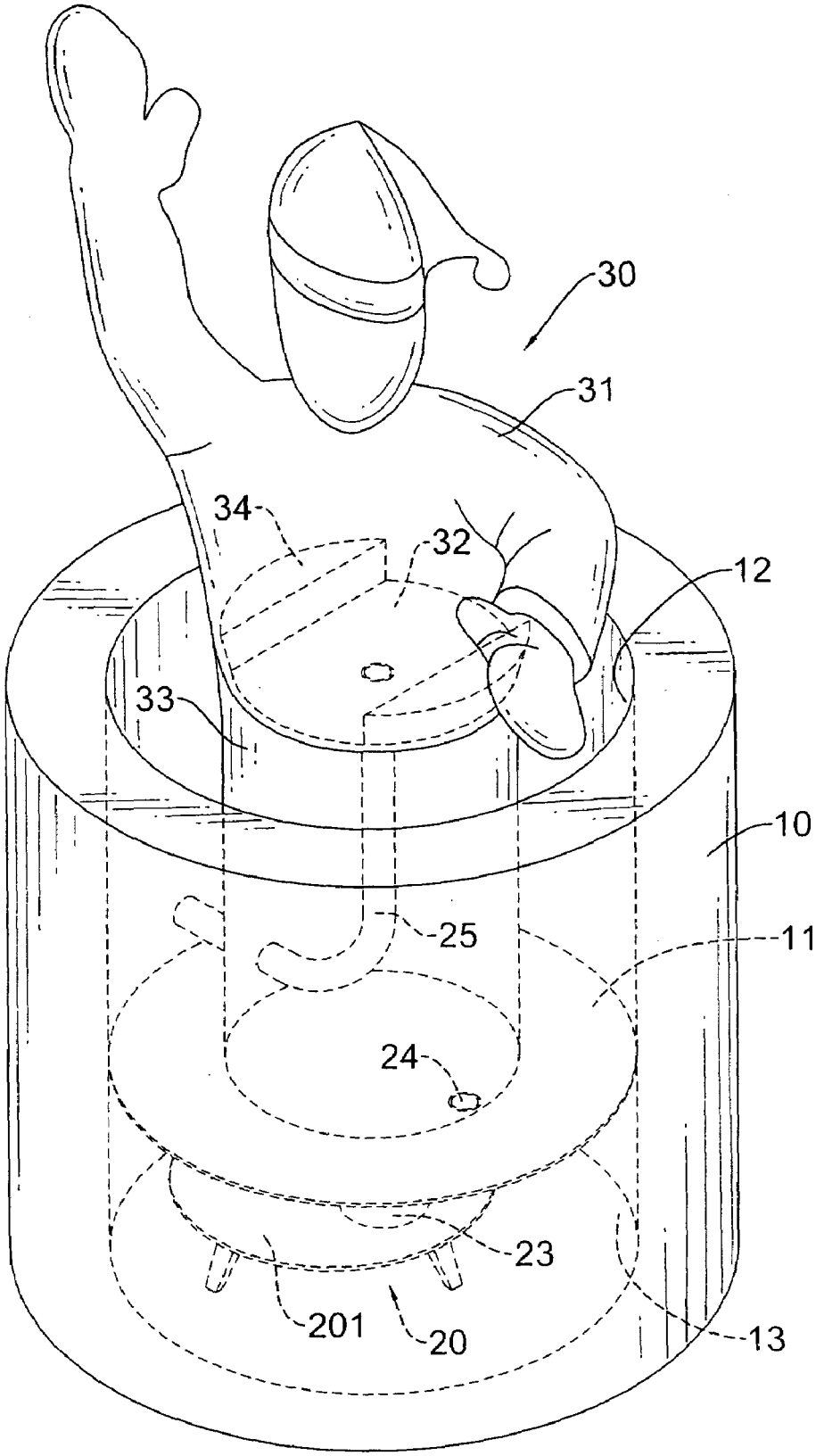
FIG. 1 is a perspective view of an inflatable doll display in accordance with the present invention.
Figure 2:
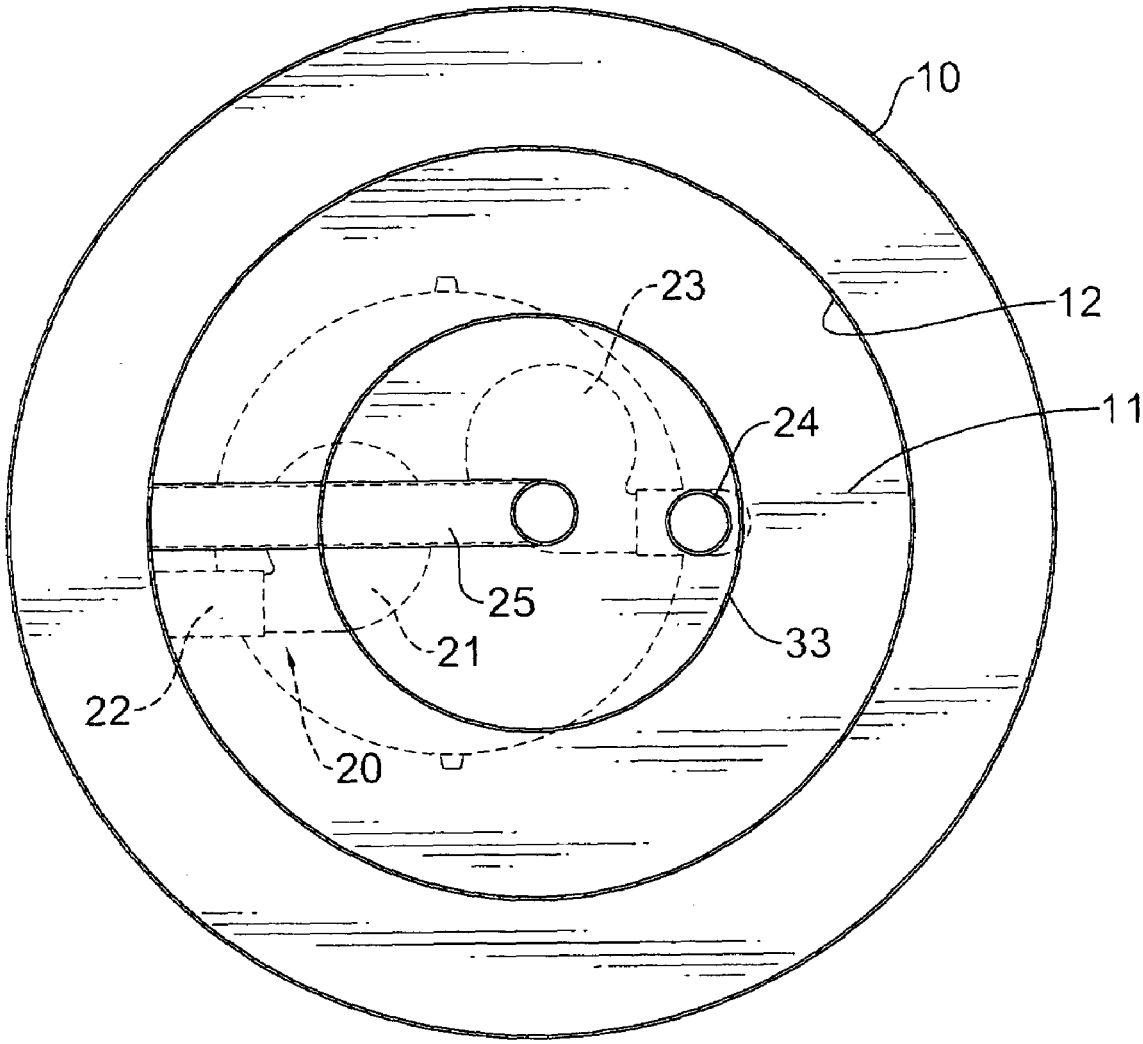
FIG. 2 is a bottom view of the inflatable doll display in accordance with the present invention.

With reference to FIGS. 1–2, an inflatable doll display comprises a hollow doll (30) made of a fabric material, a hollow barrel (10) made of the fabric material and mounted around the doll (30). The barrel (10) has an inner wall and an outer wall to form a sealing chamber and air can be pumped into the barrel (10) and doll (30).

A transverse plane (32) is provided in a middle portion of the doll (30) so that the doll (30) is formed an upper part (31) of the doll (30) and a lower part (33) of the doll (30). A transverse circular board (11) is provided in an interior of the barrel (10) so that an upper chamber (12) is defined above the circular board (11) and a lower chamber (13) is defined under the circular board (11). The doll (30) is mounted on the circular board (11) and an inflator (20) is received into the lower chamber (13). A first tube and a second tube (22, 24) are respectively connected to the inflator (20) wherein a first end of the first tube (22) is inserted between the inner wall and the outer wall of the barrel (10), and a first end of the second tube (24) is inserted into the lower part (33) of the doll (30). The doll (30) is in communication with the barrel (10) via a first end of a third tube (25) being inserted into the upper part (31) of the doll (30) and a second end of the third tube (25) being inserted into the barrel (10). The third tube (25) is substantially provided in the lower part (33) of the doll (30) and a heavy block (34) such as an earth bag or a water bag is provided on a lower end of the upper part (31) of the doll (30).

A seat (201) is formed at a lower end of the inflator (20) and a first and a second blowers (21, 23) are respectively provided on the seat (201). The first blower (21) is connected to a second end of the first tube (22) and the second blower (23) is connected to a second end of the second tube (24).

Figure 3:
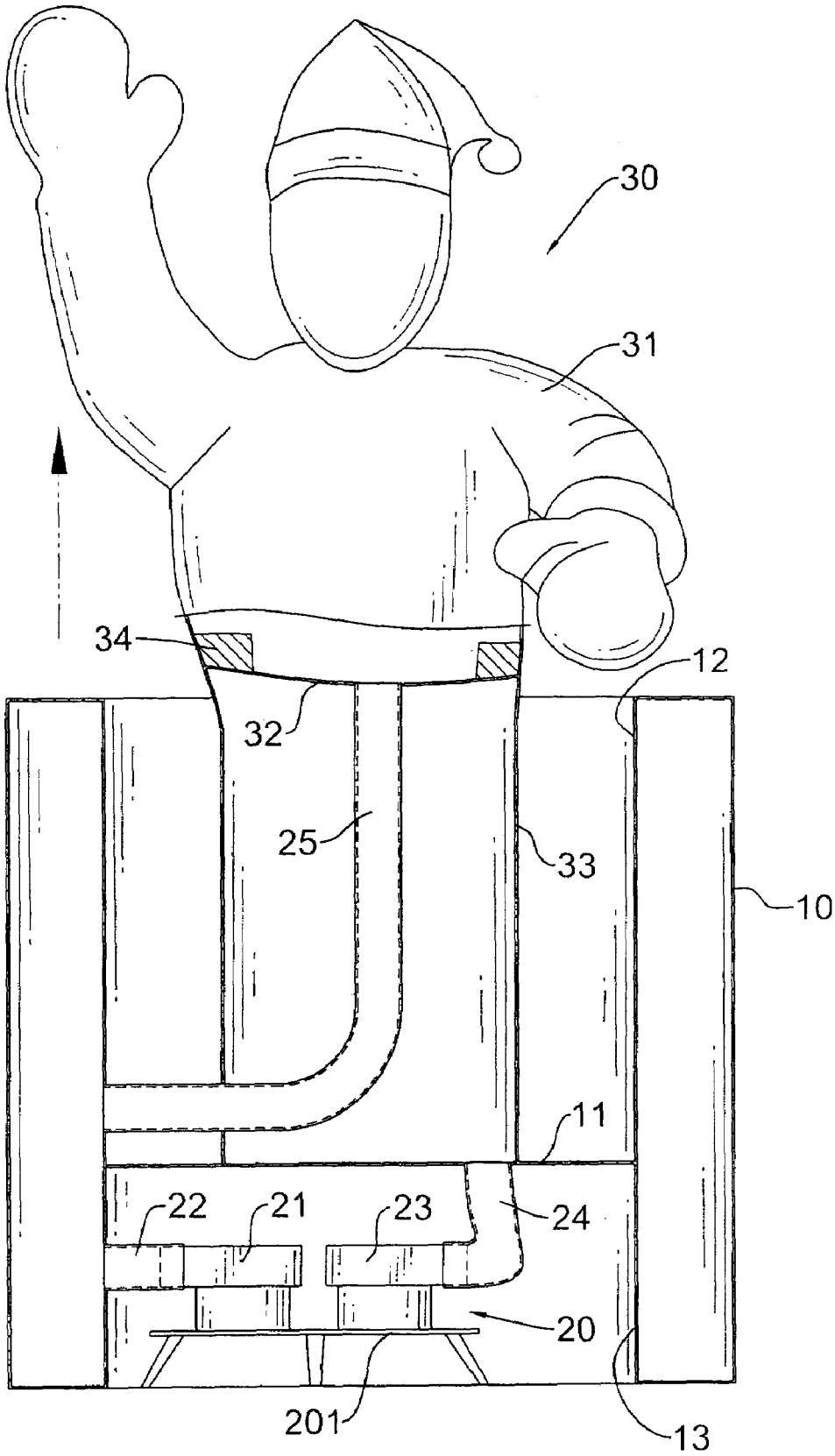
FIG. 3 is a front view of the inflatable doll display in accordance with the present invention being raised.
Figure 4:
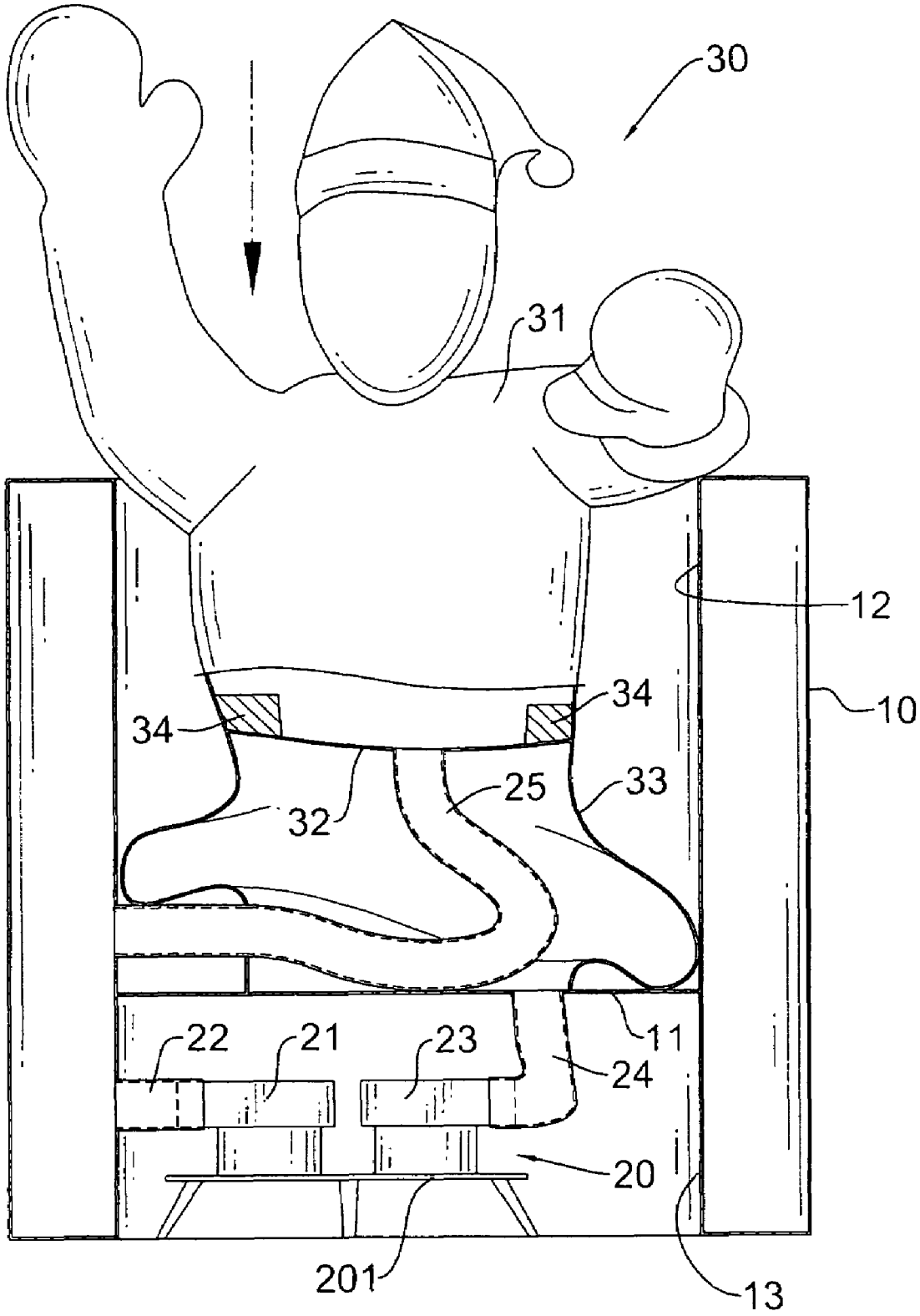
FIG. 4 is a front view of the inflatable doll display in accordance with the present invention being lowered.

With further reference to FIGS. 3–4, when the first blower (21) operates, air is pumped into the barrel (10) via the first tube (22) so that the barrel (10) is inflated to expand. Furthermore, the air enters the upper part (31) of the doll (30) via the third tube (25) so that the upper part (31) of the doll (30) is erected. When the second blower (23) operates, the air is pumped into the lower part (33) of the doll (30) via the second tube (24) so that the lower part (33) expands to push the upper part (31) to be raised. Additionally, when the second blower (23) is stopped, the air in the lower part (33) is eliminated gradually so that the upper part (31) can be lowered due to its weight. Hence, with the lower part (33) being inflated or not via the second blower (23) being operated in an alternating manner, the doll (30) is raised or lowered to achieve an attractive effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflatable doll display comprising:

a hollow fabric barrel (10) having an inner wall and an outer wall, a board (11) transversely provided in an interior of the barrel (10), whereby an upper chamber (12) is defined above the board (11) and a lower chamber (13) is defined under the board (11);

a fabric hollow doll (30) received into the barrel (10) and provided on the board (11) and having a plane (32) transversely provided in a middle portion of the doll (30), whereby an upper part (31) of the doll (30) is formed above the plane (32) and a lower part (33) of the doll (30) is formed under the plane (32);

an inflator (20) mounted in the lower chamber (13) and having a first tube (22) and a second tube (24), a first end of the first tube (22) received between the inner wall and the outer wall of the barrel (10), and a first end of the second tube (24) inserted into the lower part (33) of the doll (30), a first end of a third tube (25) inserted between the inner wall and the outer wall of the barrel (10) and a second end of the third tube (25) inserted into the upper part (31) of the doll (30) whereby the barrel (10) is in communication with the upper part (31) of the doll (30) via the third tube (25), and a block (34) is mounted on a lower end of the upper part (31) of the doll (30).

2. The inflatable doll display as claimed in claim 1, wherein a seat (201) is formed at a lower end of the inflator (20), the inflator (20) further has a first blower (21) and a second blower (23) respectively mounted on the seat (201), a second end of the first tube (22) is connected to the first blower (21) and a second end of the second tube (24) is connected to the second blower (23).

3. The inflatable doll display as claimed in claim 1, wherein the third tube (25) is provided in the lower part (33) of the doll (30).

* * * * *